US010718176B2

(12) United States Patent
Liao et al.

(10) Patent No.: US 10,718,176 B2
(45) Date of Patent: Jul. 21, 2020

(54) DRILLING SPEED IMPROVEMENT DEVICE CAPABLE OF PRODUCING BOTH HYDRAULIC PULSE AND IMPACT VIBRATION

(71) Applicant: CHINA UNIVERSITY OF PETROLEUM (EAST CHINA), Qingdao, Shandong (CN)

(72) Inventors: Hualin Liao, Shandong (CN); Jilei Niu, Shandong (CN); Zhichuan Guan, Shandong (CN); Yandong Yang, Shandong (CN); Yucai Shi, Shandong (CN); Yongwang Liu, Shandong (CN); Yuqiang Xu, Shandong (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/683,496

(22) Filed: Nov. 14, 2019

(65) Prior Publication Data

US 2020/0080379 A1 Mar. 12, 2020

Related U.S. Application Data

(63) Continuation of application No. PCT/CN2018/102266, filed on Aug. 24, 2018.

(30) Foreign Application Priority Data

Oct. 17, 2017 (CN) ..... 2017 1 0975525

(51) Int. Cl.

| | |
|---|---|
| ***E21B 31/113*** | (2006.01) |
| ***E21B 6/02*** | (2006.01) |
| ***E21B 7/24*** | (2006.01) |

(52) U.S. Cl.
CPC ..... *E21B 31/113* (2013.01); *E21B 6/02* (2013.01); *E21B 7/24* (2013.01)

(58) Field of Classification Search
CPC ..... E21B 6/02; E21B 31/113; E21B 31/1135; E21B 7/24
See application file for complete search history.

(56) References Cited

U.S. PATENT DOCUMENTS 3,063,501 A * 11/1962 Britton ..... E21B 31/113 175/297
3,209,843 A * 10/1965 Webb ..... E21B 31/113 175/297

(Continued)

FOREIGN PATENT DOCUMENTS

CN 201627541 U 11/2010
CN 104265173 A 1/2015

(Continued)

*Primary Examiner* — D. Andrews
(74) *Attorney, Agent, or Firm* — Wayne & Ken, LLC; Tony Hom

(57) ABSTRACT

The present invention discloses a drilling speed improvement device capable of producing both hydraulic pulse and impact vibration. The device has a pressure transfer rod that is arranged at an upper end of a lower joint. A spring chamber is formed among a drill body, the pressure transfer rod and the lower joint. A spring is arranged in the spring chamber. A communicating hole is formed in the drill body. A piston is arranged at an upper end of the pressure transfer rod. A pressure bearing head is arranged at an upper end of the piston. A pressure bearing base is arranged on the inner side of an upper joint. Drill bit impact loads and drilling fluid pulse jets are modulated by the longitudinal vibration energy of a drill stem, the rock breaking efficiency of a drill bit is improved by both dynamic and static loads, and harm caused by vibration of the drill stem is reduced.

3 Claims, 1 Drawing Sheet

(56) References Cited

U.S. PATENT DOCUMENTS

| | | | | | |
|---|---|---|---|---|---|
| 3,768,576 | A | * | 10/1973 | Martini | E21B 4/14 173/73 |
| 4,502,552 | A | * | 3/1985 | Martini | E21B 17/07 175/321 |
| 2014/0102804 | A1 | | 4/2014 | Cote | |

FOREIGN PATENT DOCUMENTS

| | | | |
|---|---|---|---|
| CN | 105422005 | A | 3/2016 |
| CN | 107100541 | A | 8/2017 |
| CN | 107100547 | A | 8/2017 |
| CN | 107605404 | A | 1/2018 |

* cited by examiner

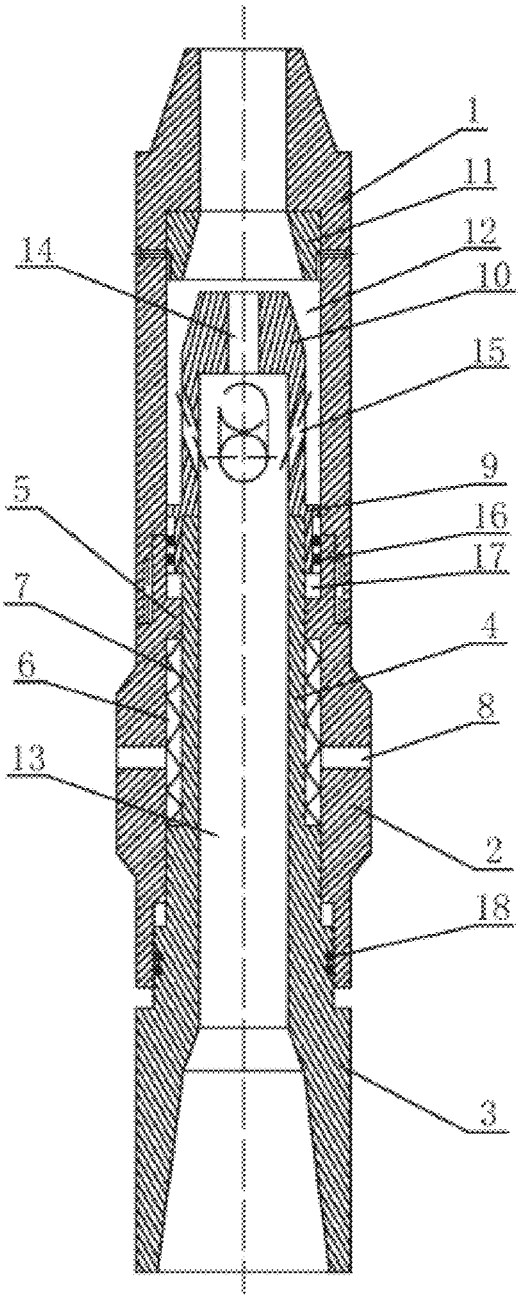
1
11
12
10
14
15
9
5
16
17
7
4
6
8
13
2
18
3

DRILLING SPEED IMPROVEMENT DEVICE CAPABLE OF PRODUCING BOTH HYDRAULIC PULSE AND IMPACT VIBRATION

CROSS-REFERENCE TO RELATED APPLICATIONS

This application is a continuation of International Patent Application PCT/CN2018/102266, filed on Aug. 24, 2018, which claims the benefit of priority from Chinese Patent Application No. 201710975525.0, filed on Oct. 17, 2017. The content of the aforementioned application, including any intervening amendments thereto, is incorporated herein by reference.

TECHNICAL FIELD

The present invention discloses a drilling speed improvement device capable of producing both hydraulic pulse and impact vibration, belonging to the technical field of design of oil drills.

BACKGROUND OF THE PRESENT INVENTION

Fast drilling in deep hard formations is a key technique that restricts the development of deep or ultra-deep well drilling. At present, low drilling efficiency in deep formations is a problem urgently to be solved. Improving the rock breaking efficiency of the drill bit is the optimal way to improve the drilling speed. There are various and complicated factors that may lead to low deep well drilling speed, among which insufficient downhole hydraulic energy and insufficient rock breaking efficiency of the drill bit, the vibration of the drill stem, and low energy utilization are major causes. How to enhance the downhole hydraulic energy, improve the rock breaking efficiency of the drill bit, and control the vibration of the drill stem is of great significance for improving the deep or ultra-deep well drilling speed. At present, most downhole pulse jet generators are mechanically blocked. It will consume part of drilling fluid hydraulic energy to drive the pulse jet modulation device to work. The modulation of the pulse jets is merely the redistribution of the primary downhole hydraulic energy, without any new energy introduced. In insufficient deep well downhole hydraulic energy case, the consumption of part of drilling fluid hydraulic energy for this redistribution may influence the working effect of the drill in the deep well. Therefore, it is necessary to use other energy to modulate the pulse jets, in order to broaden the range of well depths.

SUMMARY OF THE PRESENT INVENTION

In view of this technical problem, the present invention provides a drilling speed improvement device capable of producing both hydraulic pulse and impact vibration.

The technical solution of the present invention will be described below.

A drilling speed improvement device capable of producing both hydraulic pulse and impact vibration comprises an upper joint, a drill body and a lower joint; a lower end of the upper joint is connected to an upper end of the drill body, and a lower end of the drill body is connected to the lower joint; a pressure transfer rod, which is located in the center of the drill body, is arranged at an upper end of the lower joint; a spring chamber is formed among the drill body, the pressure transfer rod and the lower joint, and a spring is arranged in the spring chamber; a communicating hole, which communicates the spring chamber with an external annular space, is formed in the drill body; a piston is arranged at an upper end of the pressure transfer rod, a pressure bearing head is arranged at an upper end of the piston, and a pressure bearing base fitted with the pressure bearing head is arranged on the inner side of the upper joint; a booster chamber is formed between the piston, the pressure bearing head, the pressure bearing base and the upper joint; a run-through fluid channel is formed in the center of the lower joint, the pressure transfer rod and the piston; a main flow hole, which communicates the booster chamber with the fluid channel, is formed in the center of the pressure bearing head; a side flow hole, which communicates the booster chamber with the fluid channel, is formed on the periphery of the pressure bearing head; a first sliding seal is arranged between the outer wall of the piston and the inner wall of the upper joint; and a bottom space of the piston is communicated with air in the spring chamber.

Preferably, the pressure bearing base is fixedly connected to the upper joint by bolts.

Preferably, a second sliding seal is arranged between the drill body and the lower joint.

The present invention has the following beneficial effects:

drill bit impact loads and drilling fluid pulse jets are modulated by the longitudinal vibration energy of the drill stem, the rock breaking efficiency of the drill bit is improved by both dynamic and static loads, and harm caused by vibration of the drill stem is reduced.

BRIEF DESCRIPTION OF THE DRAWINGS

The present invention will be further described below with reference to the accompanying drawings by specific embodiments.

FIG. 1 is a schematic view of the structure and principle of the present invention.

REFERENCE NUMERALS

1: upper joint; 2: drill body; 3: lower joint; 4: pressure transfer rod; 5: bump; 6: spring chamber; 7: spring; 8: communicating hole; 9: piston; 10: pressure bearing head; 11: pressure bearing base; 12: booster chamber; 13: fluid channel; 14: main flow hole; 15: side flow hole; 16: first sliding seal; 17: bottom space; 18: second sliding seal.

DETAILED DESCRIPTION OF THE PRESENT INVENTION

With reference to the accompanying drawing, a drilling speed improvement device capable of producing both hydraulic pulse and impact vibration is provided, comprising an upper joint 1, a drill body 2 and a lower joint 3, which are successively mounted in the axial direction. The upper joint 1 is connected to a drill stem. A lower end of the upper joint 1 is connected to an upper end of the drill body 2 by threads, and a lower end of the drill body 2 is connected to the lower joint 3. A pressure transfer rod 4 which is located in the center of the drill body 2 and coaxial to a fluid channel 13 to be described below is arranged at an upper end of the lower joint 3. The pressure transfer rod 4 is hollow, the inner diameter of which is greater than the outer diameter of the fluid channel 13. A bump 5 is arranged on the inner wall of the drill body 2. A spring chamber 6 is formed among the drill body 2, the bump 5, the pressure transfer rod 4 and the lower joint 3, and a spring 7 is arranged in the spring chamber 6 to cushion the impact of the vibration of the drill stem in the upper portion and transfer the drilling pressure in the upper portion to the drill bit by compressing the spring. A communicating hole 8, which communicates the spring chamber 6 with an external annular space, is formed in the drill body 2. A piston 9 is arranged at an upper end of the pressure transfer rod 4, a pressure bearing head 10 is arranged at an upper end of the piston 9, and a pressure bearing base 11 fitted with the pressure bearing head 10 is arranged on the inner side of the upper joint 1. The inner diameter of the pressure bearing base 11 is greater than the outer diameter of the pressure bearing head 10. The pressure bearing base 11 is connected to the upper joint 1 by bolts. The pressure bearing base 11, the pressure bearing head 10, the piston 9 and the upper joint 1 are arranged coaxially. A booster chamber 12 is formed between the piston 9, the pressure bearing head 10, the pressure bearing base 11 and the upper joint 1. A run-through fluid channel 13 is formed in the center of the lower joint 3, the pressure transfer rod 4 and the piston 9. A main flow hole 14, which communicates the booster chamber 12 with the fluid channel 13, is formed in the center of the pressure bearing head 10. A side flow hole 15, which communicates the booster chamber 12 with the fluid channel 13, is formed on the periphery of the pressure bearing head 10. The drilling fluid in the booster chamber can arrive at the drill bit through the main flow hole 14, the side flow hole 15 and the fluid channel 13. A first sliding seal 16 is arranged between the outer wall of the piston 9 and the inner wall of the upper joint 1. A bottom space 17 of the piston 9 is communicated with air in the spring chamber 6, i.e., communicated with the annular space. In this way, the pressure difference at upper and lower ends of the piston is approximately equal to the pressure drop at the drill bit. This pressure difference applies a hydraulic drilling pressure onto the drill bit by the piston 9 and the pressure transfer rod 4.

The lower joint 3, the pressure transfer rod 4, the piston 9 and the pressure bearing head 10 may be successively connected by threads, or may be designed in an integral structure and coaxially arranged. For example, the lower joint 3 and the pressure transfer rod 4 may be designed in an integral structure, the piston 9 and the pressure bearing head 10 may be designed in an integral structure, and the pressure transfer rod 4 and the piston 9 may be connected by threads. The integral structure consisting of the lower joint 3, the pressure transfer rod 4, the piston 9 and the pressure bearing head 10 is in slide-key fit with the drill body 2. That is, the lower joint 3 or the like may move up and down with respect to the drill body 2, and the drill body 2 may drive the lower joint 3 or the like to rotate.

The bump 5 plays following roles: first, it may form the spring chamber 6 together with the pressure transfer rod 4; second, it may form the bottom space 17 together with the bottom surface of the piston, and also may serve as the lower dead point of the motion of the piston 9 to prevent the lower joint 3 from separating from the drill body 2; and third, it may function as the slide key as in the slide-key fit.

A second sliding seal 18 is arranged between the drill body 2 and the lower joint 3.

The improvement of the cuttings removal and rock breaking efficiency of the drill bit by modulating impact vibration and pulse jets by using the drilling fluid hydraulic energy as main power is limited. To overcome such limitation, the present invention provides a drilling speed improvement device capable of producing both hydraulic pulse and impact vibration. That is, drill bit drilling fluid pulse jets and impact loads are modulated by the longitudinal vibration energy of the drill stem, the rock breaking efficiency of the drill bit is improved by both dynamic and static loads, and harm caused by vibration of the drill stem is reduced.

The working process of the present invention will be described below.

During the normal drilling, the drill stem applies a mechanical drilling pressure onto the drill bit by compressing the spring 7. When the drilling pressure is too high, the spring is compressed to produce a mechanical friction that absorbs part of the drilling pressure. This protects the bearing of the drill bit and the cutting teeth, and reduces the fatigue damage of the drill. When the drilling pressure is too low, the spring is decompressed to release energy to the drill bit. This avoids bit bouncing. In this way, the drill bit is always kept in stable contact with the formation. Since the communicating hole 8 communicates the spring chamber 6 with the annular space and the pressure of the drilling fluid in the drill stem is higher than that in the annular space, the pressure difference at upper and lower ends of the piston 9 is appropriately equal to the pressure drop at the drill bit. This pressure difference applies a hydraulic drilling pressure onto the drill bit by the piston 9 and the pressure transfer rod 4. Thus, the rock breaking efficiency of the drill bit is improved by both the drilling pressure applied by the drill stem and the hydraulic drilling pressure. Due to the rotation of the drill stem, the continuous downhole rock breaking by the drill bit and other reasons, the drill stem longitudinally vibrates and displaces. As a result, the flow area of the beveled clearance between the pressure bearing base 11 and the pressure bearing head 10 changes, and the pressure in the booster chamber 12 changes too. When the drill stem goes down due to longitudinal vibration, the spring 7 is compressed, the flow area of the beveled clearance is reduced, the pressure of the fluid in the booster chamber 12 is increased because it is squeezed instantly, and both the drilling pressure applied by the drill stem and the hydraulic drilling pressure are increased. When the drill stem goes up due to vibration, the spring 7 is decompressed, the flow area of the beveled clearance is increased, the pressure in the booster chamber 12 is reduced, and both the drilling pressure applied by the drill stem and the hydraulic drilling pressure are reduced. Therefore, the drilling pressure applied by the drill stem and the hydraulic drilling pressure change periodically due to the vibration of the drill stem. By absorbing the vibration energy of the drill stem by transformation mechanisms such as springs, the drill bit breaks rocks by both dynamic and static loads. This facilitates the rock breaking efficiency of the drill bit. Additionally, due to the longitudinal vibration generated during the vibration of the drill stem or the rock breaking by the drill bit, the beveled clearance between the pressure bearing base 11 and the pressure bearing head 10 changes, the area of the flow channel for the drilling fluid in the drill stem changes, and the continuous jets passing through the nozzle of the drill bit are modulated to pulse jets. This facilitates the efficiency in cuttings removal by jets, and reduces the repeated rock breaking for the drill bit.

Related technical contents, which have not been mentioned above, may be implemented by using or referring the existing techniques.

It is to be noted that, under the teaching of this specification, any equivalent replacements and obvious variations obtained by a person of ordinary skill in the art shall fall into the protection scope of the present invention.

We claim:

1. A drilling speed improvement device capable of producing both hydraulic pulse and impact vibration, comprising an upper joint, a drill body and a lower joint; a lower end of the upper joint is connected to an upper end of the drill body, and a lower end of the drill body is connected to the lower joint; a pressure transfer rod, which is located in the center of the drill body, is arranged at an upper end of the lower joint; a spring chamber is formed among the drill body, the pressure transfer rod and the lower joint, and a spring is arranged in the spring chamber; a communicating hole, which communicates the spring chamber with an external annular space, is formed in the drill body; a piston is arranged at an upper end of the pressure transfer rod, a pressure bearing head is arranged at an upper end of the piston, and a pressure bearing base fitted with the pressure bearing head is arranged on the inner side of the upper joint; a booster chamber is formed between the piston, the pressure bearing head, the pressure bearing base and the upper joint; a run-through fluid channel is formed in the center of the lower joint, the pressure transfer rod and the piston; a main flow hole, which communicates the booster chamber with the fluid channel, is formed in the center of the pressure bearing head; a side flow hole, which communicates the booster chamber with the fluid channel, is formed in a sidewall of the pressure bearing head; a first sliding seal is arranged between the outer wall of the piston and the inner wall of the upper joint; and a bottom space of the piston is communicated with air in the spring chamber.

2. The drilling speed improvement device capable of producing both hydraulic pulse and impact vibration according to claim 1, wherein the pressure bearing base is fixedly connected to the upper joint.

3. The drilling speed improvement device capable of producing both hydraulic pulse and impact vibration according to claim 1, wherein a second sliding seal is arranged between the drill body and the lower joint.

* * * * *